US005889546A

United States Patent [19]

Fukuoka

[11] Patent Number: 5,889,546

[45] Date of Patent: Mar. 30, 1999

[54] HEAT ACCUMULATION CONTROL DEVICE FOR LINE-TYPE THERMOELECTRIC PRINTER

[75] Inventor: Hiroaki Fukuoka, Ise, Japan

[73] Assignee: Shinko Electric Co., Ltd., Tokyo, Japan

[21] Appl. No.: 660,660

[22] Filed: Jun. 4, 1996

[51] Int. Cl.[6] ..... B41J 2/36; B41J 2/365

[52] U.S. Cl. ..... 347/188

[58] Field of Search ..... 347/188, 191, 347/194; 400/120.11, 120.14, 120.15; 358/503, 296

[56] References Cited

U.S. PATENT DOCUMENTS 5,644,351 7/1997 Matsumoto et al. ..... 347/194

*Primary Examiner*—N. Le
*Assistant Examiner*—L. Anderson
*Attorney, Agent, or Firm*—Darby&Darby

[57] ABSTRACT

A heat accumulation control device is provided to control printing responsive to residual-heat values which remain in head elements of a thermal head in a line-type thermoelectric printer due to previous printing operation. The heat accumulation control device contains a line buffer for storing input data, which are supplied thereto from the printer or an external device, and a residual-heat-value storing memory which is capable of storing one line of residual-heat values corresponding to the head elements respectively. A correction calculation section performs correction calculations, using parameters, based on the input data, outputted from the line buffer, and a residual-heat value which is read out from the residual-heat-value storing memory with respect to a specific head element to be currently driven, so that print data are calculated. Thus, the specific head element is driven so that a dot is printed on a paper in a density corresponding to the print data. Further, a residual-heat-value calculation section performs calculations, using parameters, based on the print data and the residual-heat value read out from the residual-heat-value storing memory together with at least another one residual-heat value of a head element which is positioned adjacent to the specific head element in the thermal head, so that a new residual-heat value is produced with respect to the specific head element and is newly stored in the residual-heat-value storing memory.

4 Claims, 4 Drawing Sheets

HEAT ACCUMULATION CONTROL DEVICE FOR LINE-TYPE THERMOELECTRIC PRINTER

BACKGROUND OF THE INVENTION

1. Field of the Invention

The invention relates to a heat accumulation control device which controls printing operation of a line-type thermoelectric printer in response to heat accumulation of a thermal head.

2. Prior Art

The line-type thermoelectric printer, conventionally known, has a thermal head consisting of one line of head elements so that printing is performed by transferring ink onto a paper by each line. In general, it is demanded that a printing speed of the printer should be made faster. So, in order to achieve high-speed printing by the line-type thermoelectric printer, it is demanded to shorten an interval of time required between two lines of printing.

Therefore, the line-type thermoelectric printer should inevitably perform printing of a current line before heat, produced by printing of a previous line, is completely radiated from the thermal head. That is, heat must be accumulated in the thermal head by printing of respective lines. The thermal head is designed to transfer ink onto a paper in a density (or gradation) which responds to temperature of the thermal head. So, heat accumulation will cause a relatively large deviation of density (or nonuniformity of printing) between a first line and a last line printed on the paper.

According to one method of suppressing such a deviation of density, an amount of residual heat (i.e., a residual-heat value) of the thermal head is predicted based on previous input data, so that current input data are corrected based on a prediction value; and then, printing is performed using the current input data corrected. Now, one example of a construction of the line-type thermoelectric printer employing the above method will be described with reference to FIG. 3.

In FIG. 3, a numeral 1 designates a data-input section which is provided to sequentially input lines of data from a computer. Each data is designated by '$D_{jk}$'. Herein, 'j' is a variable representing a number assigned to a specific head element of the thermal head. If a total number of head elements, contained in the thermal head, is 'n', the variable j is an integer which meets inequality of $1 \leqq j \leqq n$. In addition, 'k' is a variable representing a line number designating a specific line to be printed on the paper. If a total number of lines which form one page of printing is 'L', the variable k is an integer which meets inequality of $1 \leqq k \leqq L$. Incidentally, a set of data, corresponding to one line of printing regarding a line number k, as a whole is designated by '$D_k$'.

A numeral 2 designates an allocation section which uses the data $D_{jk}$, sequentially inputted by the data-input section 1, to allocate them to 'm' groups by using '(m+1)' threshold values. Herein, each threshold value is designated by '$T_i$', wherein 'i' is a variable representing an integer which belongs to an integral range between '1' and 'm'. The (m+1) threshold values are designated by '$T_0$' to '$T_m$' respectively, which meet a relationship of $T_0 < \ldots < T_{i-1} < T_i < \ldots < T_m$. So, specific data $D_{jk}$ which meet an inequality of $T_{i-1} < D_{jk} \leqq T_i$ are allocated to a group 'i', i.e., "No. i" group within the m groups, for example.

A numeral 3 designates a count section which counts a number of the data $D_{jk}$, which are allocated to each group by the allocation section 2, i.e., a number of dots 'Si' for each group. A numeral 4 designates a residual-heat-value prediction section which uses one line of data to perform calculations in accordance with a formula (1). Herein, the residual-heat-value prediction section 4 calculates an amount of heat (i.e., residual-heat value) 'Q', which remains in the thermal head after printing of one line, by prediction.

$$Q = f(\Sigma_{i-1}^{m} Ai,\ Si,\ T,\ k) \tag{1}$$

In the above formula (1), 'T' designates a print period for one line of printing; 'Ai' designates a count number which is assigned to each group; 'f' designates a predetermined function using parameters Ai, Si, T and k. The function and parameters are set in advance based on usage environment regarding characteristics of the thermal head, printer and ink.

A numeral 5 designates a print-data calculation section which calculates print data $d_{jk}$ in accordance with a formula (2), wherein the print data $d_{jk}$ are data actually transferred to the thermal head for the printing.

$$d_{jk} = F(Q,\ D_{jk}) \tag{2}$$

In the formula (2), 'F' designates a function which is set in advance in accordance with usage environment. Next, a numeral 6 designates a print-data transfer section which transfers one line of print data '$d_k$' calculated by the print-data calculation section 5, to the thermal head, wherein '$d_k$' represents one line of data for a line k. A numeral 7 designates a thermal-head drive section which drives the thermal head based on the print data transferred thereto from the print-data transfer section 6. Next, operation of the line-type thermoelectric printer, which is constructed as shown by FIG. 3, will be described with reference to a flowchart of FIG. 4.

When the printer inputs one line of data $D_{11}, D_{21}, \ldots, D_{n1}$ by the data-input section 1, the printer starts to execute procedures of the flowchart of FIG. 4. At first, the printer proceeds to steps S1 and S2, wherein initial setting is performed. Then, the printer proceeds to step S3 in which a decision is made as to whether a last line of printing has not been completed yet. In the current situation, however, the printer proceeds with process regarding a first line of printing (or printing of a line k where k=1). So, result of the decision turns to "YES". Thus, the printer proceeds with following procedures.

Steps S4 to S11 are provided to mainly perform two processes, i.e., an allocation process, which allocates the data $D_{11}, D_{21}, \ldots, D_{n1}$ to the m groups respectively, and a count process which counts a number of dots 'Si' for each group. After completion of these processes, if result of a decision made by step S5 turns to 'NO', the calculations using the aforementioned formulae (1) and (2) are performed in steps S12 and S13. Thus, print data $d_{11}, d_{21}, \ldots, d_{n1}$ are calculated, so that printing is performed based on those print data in step S14.

Thereafter, the aforementioned processes are repeated with respect to a second line, a third line and other lines in turn. However, even if the line which is subjected to the processes is changed, the number of dots Si is not reset but is sequentially accumulated. Thus, it is possible to perform heat control of the thermal head with prediction of heat-accumulated state. After the processes are completed with respect to a line 'n' so that result of a decision made by step S3 turns to 'NO', the printer ends the procedures of the flowchart.

By the way, the deviation of density in the line-type thermoelectric printer is varied in a variety of print patterns.

In the line-type thermoelectric printer, there should occur a "tailing phenomenon" in which a density of a dot, which is printed following a dot printed in a high density, should become higher than a density expected. However, the line-type thermoelectric printer performs same heat control if the residual-heat value Q, calculated by the aforementioned formula (1), remains the same, regardless of print patterns. So, the conventional printer suffers from drawbacks that the printer cannot eliminate the trailing phenomenon and deviation of density which occur or alter responsive to the print pattern.

Meanwhile, a dye sublimation printer is provided to obtain a high print quality which is almost equivalent to the quality of photograph and is designed to differ printing energy with respect to each level of gradation (or each level of density). So, this printer is delicately affected by heat accumulation of the head thereof. Thus, it is demanded to provide a method or a device by which the printing energy is adequately controlled based on a heat-accumulated state which is predicted with consideration of the print pattern.

The data-input section 1 of the line-type thermoelectric printer shown in FIG. 3 is configured by a RAM having one page of storage (i.e., a page buffer). Therefore, this printer is designed to avoid a situation where a line of data to be processed are not inputted thereto from the computer. Recently, RAMs are made in a relatively low price. However, a high price should be required for a page buffer having a large capacity which is capable of storing one page of image data, for example.

If the printer does not provide such a large-capacity page buffer, there should occur a situation where a line of data to be processed are inputted thereto from a computer if the computer performs data transfer at a low speed. In such a situation, the printer should break printing operation during an unpredictable time before printing of a next line. If the printer re-starts the printing operation after the breaking, the residual-heat value Q of the thermal head is lowered responsive to a break time. However, the printer does not consider the break time. So, the residual-heat value Q calculated should be identical to the residual-heat value which is calculated under the condition where the printing operation smoothly continues without a break. In other words, the residual-heat value calculated should differ from a residual-heat value representing an amount of residual heat actually owned by the thermal head. And, a difference between them should increase responsive to the break time. As a result, the printer should provide an expensive page buffer in order to avoid occurrence of the deviation of density (or deviation of color). However, provision of the page buffer does not perfectly avoid occurrence of the deviation of density because of the reasons described before.

SUMMARY OF THE INVENTION

It is an object of the invention to provide a heat accumulation control device which avoids occurrence of inconveniences such as the deviation of density and trailing phenomenon due to heat accumulation of a thermal head of the line-type thermoelectric printer without providing a page buffer. Herein, those inconveniences are caused to occur in a print mode of a certain print pattern; or those inconveniences are caused to occur in the case where the page buffer is not provided and printing operation is broken sometimes so that print periods for print lines may not be made constant.

A heat accumulation control device is provided to control printing responsive to residual-heat values which remain in head elements of a thermal head in a line-type thermoelectric printer due to previous printing operation.

The heat accumulation control device of the invention contains a line buffer for storing input data, which are supplied thereto from an external device, and a residual-heat-value storing memory which is capable of storing one line of residual-heat values corresponding to the head elements respectively. A correction calculation section performs correction calculations, using parameters, based on the input data, outputted from the line buffer, and a residual-heat value which is read out from the residual-heat-value storing memory with respect to a specific head element to be currently driven, so that print data are calculated. Thus, the specific head element is driven so that a dot is printed on a paper in a density corresponding to the print data. Further, a residual-heat-value calculation section performs calculations, using parameters, based on the print data and the residual-heat value read out from the residual-heat-value storing memory together with at least another one residual-heat value of a head element which is positioned adjacent to the specific head element in the thermal head, so that a new residual-heat value is produced with respect to the specific head element. The new residual-heat value is newly stored in the residual-heat-value storing memory. Thus, the residual-heat-value storing memory can normally store a new set of residual-heat values with respect to the head elements respectively.

Moreover, the heat accumulation control device is designed to cope with a dummy process mode in which dummy printing is performed. Herein, if the line buffer does not finish inputting one line of input data at a print-start timing, dummy data, representing a lowest level of gradation, are supplied to the correction calculation section. Thus, the correction calculation section performs the correction calculation based on the dummy data instead of the input data.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Figure 1:
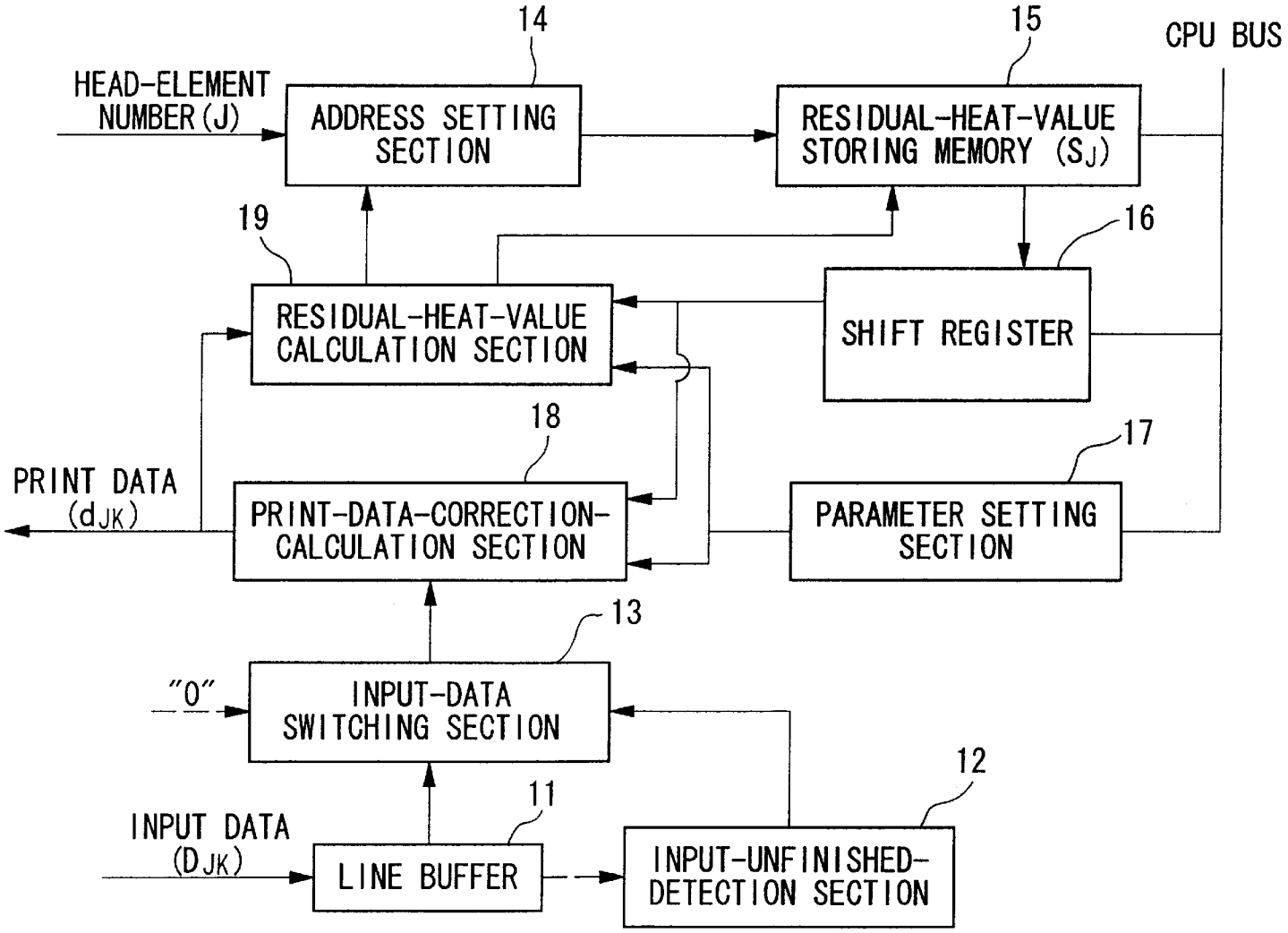
FIG. 1 is a block diagram showing a configuration of a heat accumulation control device for a line-type thermoelectric printer in accordance with an embodiment of the invention.

FIG. 1 is a block diagram showing a configuration of a heat accumulation control device for a line-type thermoelectric printer according to an embodiment of the invention. The heat accumulation control device of FIG. 1 is built in the line-type thermoelectric printer which has a thermal head consisting of 'n' heat elements and which is capable of printing maximum 'L' lines on a paper. Other than the aforementioned heat accumulation control device and thermal head, the line-type thermoelectric printer provides a drive mechanism of the thermal head as well as a central processing unit (i.e., CPU) which controls operations of parts and sections of the printer. Operations of the blocks shown in FIG. 1 are synchronized together by same clocks.

In FIG. 1, a line buffer 11 has a storage capacity which corresponds to at least one line of data. In short, the line buffer 11 temporarily stores one line of data for printing which are supplied from a computer or another external device. Herein, input data of the line buffer 11 are designated by '$D_{JK}$' while '$D_K$' designates input data of a line K, wherein numerals J and K are integers which meet inequalities of $1 \leqq J \leqq n$ and $1 \leqq K \leqq L$. After storing one line of input data, the line buffer 11 sequentially output the data by each dot when it comes to a predetermined timing. Incidentally, the line buffer 11 is designed to clear stored content thereof when the line buffer 11 completely outputs all the data thereof.

An input-unfinished-detection section 12 is provided to detect an input-unfinished event in which the line buffer 11 does not finish inputting of one line of input data $D_K$. So, the input-unfinished-detection section 12 outputs result of detection thereof. An input-data switching section 13, which follows the line buffer 11, switches over transmission between output data of the line buffer 11 (i.e., input data $D_{JK}$) and data '0'. Herein, the data 0 represent non-existence of dots, e.g., a lowest level of gradation. The data '0' can be supplied to the input-data switching section 13 from an external device (not shown); or the data 0 can be created by the input-data switching section 13 by itself.

An address setting section 14 generates an address which corresponds to a value given from a CPU (not shown), wherein this value represents a head-element number J added with '1'. A residual-heat-value storing memory 15 is configured by a RAM having one line of storage capacity. This memory 15 stores one line of residual-heat values for the head elements respectively. Herein, the residual-heat value regarding a head element represents an amount of heat which remains in the head element at some moment existing between a first moment, at which the head element prints a dot, and a second moment at which the head element is placed in a timing to print a next dot.

A shift register 16 is provided to temporary store a residual-heat value and is capable of storing 3 dots of data. One dot of data are read out from the address generated by the address setting section 14 provided for the residual-heat-value storing memory 15, so that the data are supplied to the shift register 16. Thus, dots of data are stored in the shift register 16 with being sequentially shifted. A parameter setting section 17 is connected with a CPU bus. The parameter setting section 17 sets parameters, used for a variety of calculations, at values which are inputted thereto through the CPU bus. The CPU bus interconnects with the residual-heat-value storing memory 15 and the shift register 16 as well.

A print-data-correction-calculation section 18 performs correction calculations based on 3 dots of data, stored by the shift register 16, parameters, set by the parameter setting section 17, and data (i.e., input data $D_{JK}$ or data 0), transmitted thereto through the input-data switching section 13, in accordance with a following formula (3). Thus, the print-data-correction-calculation section 18 produces print data $d_{JK}$ representing printing energy with respect to a dot J.

$$d_{JK}=f(D_J, \delta S_J, \gamma S_{J+1}, \gamma S_{J-1}) \quad (3)$$

In the above formula (3), γ and δ designate parameters which are set by the parameter setting section 17; and 'f' designates a function which is arbitrarily preset based on usage environment. A concrete example of the function f, applied to the formula (3), can be expressed by a formula (4), as follows:

$$d_{JK}=D_J-\delta S_J-\gamma(S_{J+1}+S_{J-1}) \quad (4)$$

Incidentally, FIG. 1 omits illustration of a buffer which is provided for dummy printing. This buffer accumulates one line of the print data $d_{JK}$ which are sequentially outputted from the print-data-correction-calculation section 18, so that data accumulated are supplied to a drive circuit (not shown) of the thermal head.

A residual-heat-value calculation section 19 calculates a residual-heat value $S_J$ with respect to each head element. The residual-heat-value calculation section 19 performs calculations based on 3 dots of data stored by the shift register 16, parameters set by the parameter setting section 17 and print data $d_{JK}$ outputted from the print-data-correction-calculation section 18 in accordance with a following formula (5), thus calculating a residual-heat value with respect to a head element J. This residual-heat-value calculation section 19 outputs a value (J-1) to the address setting section 14. In addition, the residual-heat-value calculation section 19 outputs the residual-heat value calculated to the residual-heat-value storing memory 15 so as to renew the residual-heat value stored at an address corresponding to the head element J.

$$S_J=F(\alpha d_J, \delta S_J, \gamma S_{J+1}, \gamma S_{J-1}) \quad (5)$$

In the above formula (5), 'α' designates a parameter which is set by the parameter setting section 17; and 'F' designates a function which is arbitrarily set in advance based on usage environment. A concrete example of the function F, applied to the formula (5), can be expressed by a formula (6), as follows:

$$S_J=\alpha d_J+\delta S_J+\gamma(S_{J+1}+S_{J-1}) \quad (6)$$

Figure 2:
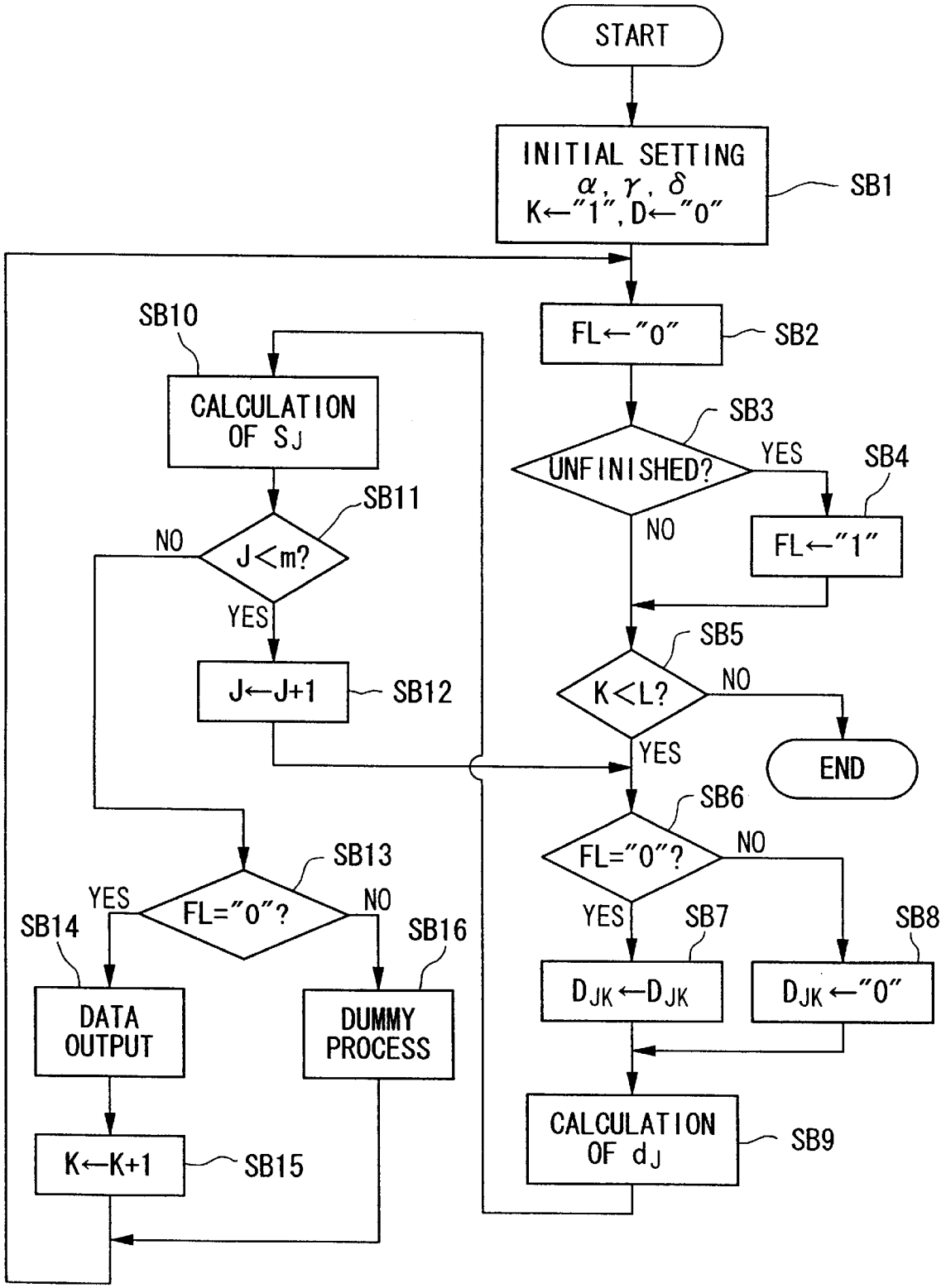
FIG. 2 is a flowchart showing operation of the heat accumulation control device according to the embodiment of the invention.
Figure 3:
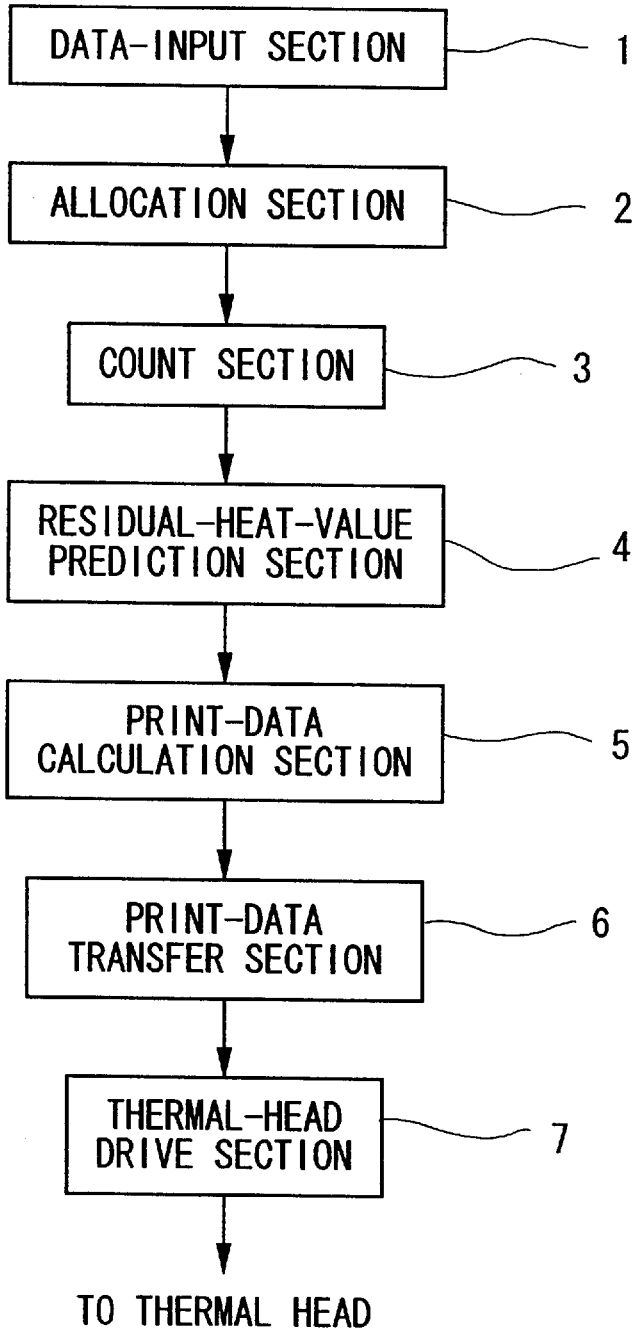
FIG. 3 (PRIOR ART)
FIG. 3 is a block diagram showing a configuration of a selected part of the conventional line-type thermoelectric printer.
Figure 4:
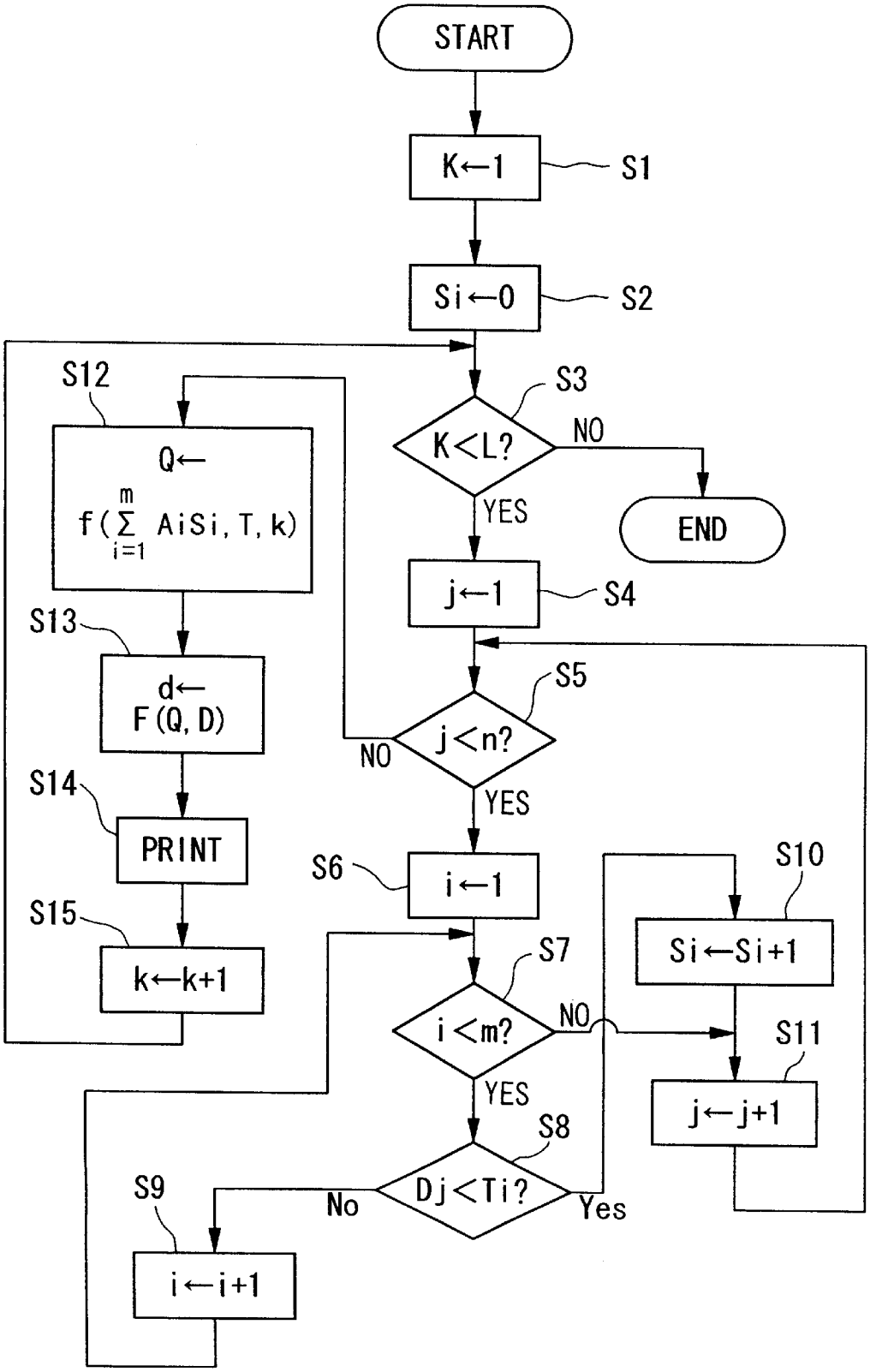
FIG. 4 (PRIOR ART)
FIG. 4 is a flowchart showing operation of the line-type thermoelectric printer of FIG. 3.

Next, concrete operation of the heat accumulation control device of FIG. 1 will be described with respect to FIG. 2. FIG. 2 is a flowchart showing procedures executed by the heat accumulation control device of the line-type thermo-electric printer in accordance with the present embodiment. At first, when electric power is applied to the printer, the printer is placed in a print enable state. So, when receiving a signal, instructing the printer to start printing, from an external device, the printer proceeds to step SB1. The step SB1 performs initial setting such that data '00 . . . 0' are supplied to the residual-heat-value storing memory 15 through the CPU bus whilst data '0,0,0' are supplied to the shift register 16 through the CPU bus.

In addition, the parameters α, γ and δ, which are used by the aforementioned formulae (3) to (6), are supplied to the parameter setting section 17 through the CPU bus. Those parameters are used by calculations executed by the print-data-correction-calculation section 18 and residual-heat-value calculation section 19 respectively. Further, a number '1' is put into a variable K, so that processes are set to be executed for a first line (i.e., a line 1).

The present embodiment provides a normal process mode and a dummy process mode which are switched over. In step SB2, a value '0' representing designation of the normal process mode is put into a variable FL. In addition, a number '0' is inputted to the address setting section 14 as a head-element number J. Thus, a residual-heat value $S_1$ is read out from an address 1 (whose number is calculated by addition of '0+1') of the residual-heat-value storing memory 15, so that the residual-heat value $S_1$ is supplied to the shift register 16. As a result, stored content of the shift register 16 can be expressed as '0,0,$S_1$'. Thereafter, a number '1' is inputted to the address setting section 14 as the head-element number J. Thus, stored content of the shift register 16 is changed to '0,$S_1$,$S_2$'. In parallel with the above operations, input data $D_{JK}$ are sequentially inputted to and temporarily stored in the line buffer 11.

In step SB3, a decision is made as to whether or not a job to temporarily store one line of input data $D_{11}, D_{21}, \ldots, D_{n1}$ into the line buffer 11 is unfinished. If result of the decision is "YES", the printer proceeds to step SB4 wherein a value '1' representing designation of the dummy process mode is put into the variable FL. Then, the printer proceeds to step SB5.

On the other hand, if result of the decision made by step SB3 is "NO", the printer directly proceeds to step SB5 under the situation where the normal process mode is designated. In step SB5, a decision is made as to whether one page of printing is not completed. Specifically, step SB5 performs comparison between 'K', representing a line which is currently placed under printing, and 'L' representing a maximum line number. In the present situation, 'K' is set at '1' which is less than 'L'. Thus, result of the decision turns to "YES", so that the printer proceeds to step SB6.

In step SB6, a decision is made as to whether or not the variable FL is set at '0'; in other words, a decision is made as to whether or not the normal process mode is currently designated. If result of the decision is "YES", the printer proceeds to step SB7. But, if result of the decision is "NO", the printer proceeds to step SB8. Step SB7 is provided for the normal process mode, wherein one dot of input data '$D_{JK}$' (actually '$D_{11}$') within one line of input data stored in the line buffer 11 are supplied to the print-data-correction-calculation section 18.

In contrast, step SB8 is provided for the dummy process mode, wherein data '0' are outputted from the input-data switching section 13 and are supplied to the print-data-correction-calculation section 18 as the input data $D_{JK}$ (i.e., $D_{11}$). In the normal process mode, actual input data are used as an object to be processed by the print-data-correction-calculation section 18. However, in the dummy process mode, dummy data '0' are used as the object to be processed. After completion of step SB7 or step SB8, the printer proceeds to step SB9.

In step SB9, the print-data-correction-calculation section 18 performs correction calculations to produce print data $d_{JK}$. The correction calculations are performed based on the input data $D_{JK}$, outputted from the input-data switching section 13, stored content of the shift register 16 and parameters γ, δ, set by the parameter setting section 17, in accordance with the aforementioned formula (4). In the current situation, the stored content of the shift register 16 is expressed as '0,$S_1$,$S_2$'. So, print data $d_{11}$, which correspond to a first dot to be printed within a line, are made based on residual-heat values $S_1$ and $S_2$ which are provided for a head element, corresponding to the first dot, and its adjacent head element respectively.

Next, the printer proceeds to step SB10 wherein the residual-heat-value calculation section 19 performs calculations to produce a residual-heat value $S_1$ with respect to a first head element (i.e., a head element 1) after the dot is printed in a density corresponding to the print data $d_{11}$. The calculations are performed based on stored content of the shift register 16, parameters α, γ, δ, set by the parameter setting section 17, and the aforementioned print data $d_{11}$ in accordance with the aforementioned formula (6).

As similar to the case where the aforementioned print data $d_{11}$ are produced, the residual-heat value $S_1$ newly calculated is made based on the residual-heat values $S_1$ and $S_2$ which are provided for the head element, corresponding to $S_1$, and its adjacent head element respectively. In other words, the residual-heat value $S_1$ newly calculated is made based on a previous value of $S_1$, corresponding to the head element thereof after printing of the dot, and a present value of $S_2$, corresponding to its peripheral head element. Then, the residual-heat value $S_1$ is overwritten at the address 1 of the residual-heat-value storing memory 15.

In step SB11, a decision is made as to whether the print-data-correction-calculation section 18 does not finish to output one line of print data $d_{11}$ to $d_{m1}$. Specifically, a decision is made as to whether 'J' is smaller than 'm'. In the present situation, 'J' is set at '1' which is smaller than 'm', so that result of the decision turns to "YES". Thus, the printer proceeds to step SB12, wherein '1' is added to 'J'. After completion of step SB12, the printer proceeds back to step SB6 again. Thereafter, the processes of steps SB6 to SB12 are repeated until step SB11 determines that an inequality of '$J \geqq m$' is established.

The repeat of the processes of steps SB6 to SB12 is different from first execution of the processes of steps SB6 to SB12 described before in such a way that in the case of $1<J<m$, stored content of the shift register 6 turns to '$S_{J-1}$, $S_J$,$S_{J+1}$'. This indicates that print data $d_{j1}$ are calculated based on a residual-heat value of a specific heat element together with residual-heat values of its adjacent two head elements. In the case of J=m, stored content of the shift register turns to '$S_{m-1}$,$S_m$,0', which indicates that print data $d_{m1}$ are calculated based on a residual-heat value of a specific head element to be currently driven together with a residual-heat value of its adjacent one head element. By repeating the aforementioned processes, it is possible to obtain one line of print data $d_{11}, d_{21}, \ldots, d_{m1}$, by which residual-heat values $S_1$ to $S_m$. stored in the residual-heat-value storing memory 15, are renewed. Incidentally, one line of print data $d_{11}, d_{21}, \ldots, d_{m1}$ are stored in a line buffer (not shown).

If result of the decision made by step SB11 turns to "NO", the printer proceeds to step SB13. In step SB13, a decision is made as to whether or not the variable FL is set at '0'. In other words, a decision is made as to whether or not the normal process mode is designated. If result of the decision is "YES", the printer proceeds to step SB14. In step SB14, one line of print data $d_{11}, d_{21}, \ldots, d_{m1}$, stored in the line buffer (not shown), are transferred to a thermal-head drive section (not shown), so that one line of printing is performed. Thus, a paper or the thermal head is fed forward by one line in a paper-feed direction. Next, '1' is added to the line number K in step SB15. Then, the printer proceeds back to step SB2 again.

On the other hand, if result of the decision made by step SB13 turns to "NO", the printer proceeds to step SB16, wherein dummy process will be performed, as follows:

A dummy process section (not shown) operates to prevent print data dK, outputted from the print-data-correction-calculation section 18, from being supplied to the thermal head. Thus, actual printing (i.e., driving of the thermal head) and addition of K are not performed; but a wait time is set to maintain process cycle which is equivalent to the process cycle employed for the actual printing. Then, the printer proceeds back to step SB2 again.

Thereafter, the aforementioned processes are repeated until result of the decision made by step SB5 turns to "NO", i.e., until one line of printing is completed.

As described heretofore, the present embodiment is designed in such a way that the print data $d_J$ are calculated using a new set of residual-heat values $S_1$ to $S_m$ which are stored in the residual-heat-value storing memory 15 with respect to the head elements respectively. Therefore, it is possible to precisely calculate residual-heat values with respect to an arbitrary print pattern. In addition, it is possible to accurately control the density (i.e., printing energy) represented by the print data $d_J$. Thus, it is possible to avoid occurrence of the deviation of density and trailing phenomenon.

In addition, the present embodiment is designed in such a way that printing energy is controlled more precisely by considering not only a residual-heat value of a specific head element to be currently driven but also at least another one residual-heat value of its adjacent head element. So, it is possible to obtain printing results with a high quality. Further, if a data-transmission speed from an external device is slower than a printing speed of the printer, content of the input data $D_{JK}$ is assumed as '0', so that calculations, similar to those of the normal process mode, are repeated by constant cycle, which is identical to that of the normal process mode, without carrying out paper-feed operation. Thus, it is possible to avoid occurrence of the deviation of density without providing an expensive page buffer.

Moreover, the present embodiment is designed in such a way that a residual-heat value of a specific heat element to be currently driven is calculated based on a residual-heat value of its adjacent head element or residual-heat values of its adjacent two head elements. This is because one head element should be mutually affected by other head elements. So, the above calculation for the residual-heat value of the specific head element to be currently driven is determined to provide an object that errors due to mutual effects among the head elements are reduced. In other words, the above calculation can be modified as long as it provides the above object. In short, the configuration and operation, employed by the invention, are not limited to those of the present embodiment.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. A heat accumulation control device for a thermal head of a line-type thermoelectric printer responsive to input print data from an external device for controlling the heat applied to individual heat elements of the thermal head in which one line of print data is supplied to a thermal-head drive means to heat each of the heat elements of the thermal head to the level necessary to transfer ink onto a paper in a density corresponding to the print data and which produces a residual-heat value for the thermal head heat elements, comprising:

residual-heat-value storing means for storing residual-heat values for the thermal head heat elements for one line of data to be printed;

correction calculation means for reading out from said residual-heat-value storing means a residual-heat value corresponding to a specific thermal head heat element to be driven and to calculate print data based on the read residual-heat value and input data corresponding to the specific heat element; and residual-heat-value-calculation means for calculating a new residual-heat value for the specific head element based on the residual-heat value read from said residual-heat-value storing means and the print data for the specific element to calculate a new residual-heat value to be stored in said residual-heat-value storing means.

2. A heat accumulation control device for a thermal head of a line-type thermoelectric printer responsive to input print data from an external device for controlling the heat applied to individual heat elements of the thermal head in which one line of print data is supplied to a thermal-head drive means to heat each of the heat elements of the thermal head to the level necessary to transfer ink onto a paper in a density corresponding to the print data and which produces a residual-heat value for the thermal head heat elements; comprising:

residual-heat-value storing means for storing residual-heat values for the thermal head elements for one line of data to be printed;

correction calculation means for reading out from said residual-heat-value storing means a residual-heat value corresponding to a specific thermal head element to be driven to calculate print data based on the read residual-heat value and input data corresponding to the specific head element;

residual-heat-value-calculation means for calculating a new residual-heat value for the specific head element based on the residual-heat value read from said residual-heat-value storing means and the print data for the specific element to calculate a new residual-heat value to be stored in said residual-heat-value storing means; and dummy print means for allowing or inhibiting the print data calculated by said correction calculation means to be supplied to the thermal-head drive means, wherein if at a print-start timing an amount of input data which is not printed is less than one line, said dummy print means prevents the print data calculated by said correction calculation means from being supplied to said thermal-head drive means so that the correction calculation means uses data representing the level of heat needed by a thermal head element to produce the lowest level ink density desired instead of using the input data to calculate the print data.

3. A heat accumulation control device for a line-type thermoelectric printer having a thermal head with one line of head elements to be individually heated to perform line-by-line printing by the line of thermal head elements on a paper in response to input data, comprising:

a residual-heat-value storing memory for storing one line of residual-heat values corresponding to the one line of head elements;

parameter setting means for setting calculation parameters;

a line buffer for storing one line of input data;

correction calculation means for performing correction calculations using the parameters set by said parameter setting means, the input data supplied from the line buffer, and a residual-heat value which is read out from said residual-heat-value storing memory with respect to a specific head element to be driven for producing print data with respect to the specific head element; and residual-heat-value calculation means for performing calculations using the parameters set by said parameter setting means, the print data calculated by said correction calculation means and the residual-heat value read out from said residual-heat-value storing memory together with at least one other residual-heat value of a head element which is positioned adjacent to the specific head element in the thermal head for producing a new residual-heat value for the specific head element which is newly stored in said residual-heat-value storing memory, whereby the specific head element is driven responsive to the print data so that a dot of ink printed on the paper has a density represented by the print data.

4. A heat accumulation control device for a line-type thermoelectric printer having a thermal head with one line of head elements to be individually heated to perform line-by-line printing by the line of thermal head elements on a paper in response to input data, comprising:

a residual-heat-value storing memory for storing one line of residual-heat values corresponding to the one line of head elements;

parameter setting means for setting calculation parameters;

a line buffer for storing one line of input data;

correction calculation means for performing correction calculations using the parameters set by said parameter setting means, the input data supplied from the line buffer, and a residual-heat value which is read out from said residual-heat-value storing memory with respect to a specific head element to be driven for producing print data with respect to the specific head element; and residual-heat-value calculation means for performing calculations using the parameters set by said parameter setting means, the print data calculated by said correction calculation means and the residual-heat value read out from said residual-heat-value storing memory together with at least one other residual-heat value of a head element which is positioned adjacent to the specific head element in the thermal head for producing a new residual-heat value for the specific head element which is newly stored in said residual-heat-value storing memory, whereby the specific head element is driven responsive to the print data so that a dot of ink printed on the paper has a density represented by the print data;

input-unfinished-detection means for detecting whether one line of input data is completely inputted to said line buffer; and input-data switching means for switching over transmission of the input data outputted from said line buffer for said correction calculation means on the basis of result of detection of the input-unfinished-detection means, whereby if the line buffer does not complete inputting one line of input data before a print-start time, said input-data switching means transmits dummy data representing the level of heat needed to produce the lowest level ink density to the correction calculation means so that said correction calculation means performs the correction calculations based on the dummy data instead of the input data.

* * * * *